US005833198A

United States Patent [19]

Graetz

[11] Patent Number: 5,833,198

[45] Date of Patent: Nov. 10, 1998

[54] MECHANICALLY OPERATED LIFT TABLE

[75] Inventor: Alton Graetz, Pound, Wis.

[73] Assignee: Graetz Manufacturing Inc., Pound, Wis.

[21] Appl. No.: 861,550

[22] Filed: May 22, 1997

[51] Int. Cl.[6] ..... A47G 29/00

[52] U.S. Cl. ..... 248/370; 248/588

[58] Field of Search ..... 248/370, 584, 248/588, 421, 161; 108/145

[56] References Cited

U.S. PATENT DOCUMENTS

| | | | |
|---|---|---|---|
| 264,458 | 9/1882 | Johnson | 108/145 |
| 3,888,451 | 6/1975 | Lacey | 248/423 |
| 3,984,078 | 10/1976 | Sturhan | 248/421 |
| 4,029,283 | 6/1977 | Swenson et al. | 248/399 |
| 4,072,287 | 2/1978 | Swenson et al. | 248/399 |
| 4,273,306 | 6/1981 | Chang | 248/421 |
| 5,011,109 | 4/1991 | Nagata | 248/588 |
| 5,169,112 | 12/1992 | Boyles et al. | 248/421 |
| 5,364,060 | 11/1994 | Donovan et al. | 248/588 |
| 5,632,209 | 5/1997 | Sakakibara | 248/588 |

OTHER PUBLICATIONS

Bishamon Industries Corporation Brochure: *Quality & Value;* 1996.

Southworth Brochure; *What's New at ProMat 97 Productivity Solution Through Material Handling;* 1997.

Presto Material Handling Brochure; *Presto Pneumatic Lifts and Tilters;* Catalog A96.

*Primary Examiner*—Ramon O. Ramirez
*Assistant Examiner*—Robert Lipesik
*Attorney, Agent, or Firm*—Nilles & Nilles, S.C.

[57] ABSTRACT

A lift table includes a support table assembly mounted on a scissor arm mechanism. The support table assembly is raised and lowered automatically upon the imposition or removal of loads so that the height of the plane on which articles are being handled remains generally constant. Raising and lowering is effected via a lift spring assembly that acts without the assistance of any pneumatic or hydraulic actuators. The scissor arm mechanism of the lift table has angled arms and low-friction rollers to facilitate raising and lowering of the support table assembly and optimizing operation of the lift spring assembly. The resulting mechanically operated lift table is simple, reliable, and can be easily transported from location to location.

4 Claims, 6 Drawing Sheets

MECHANICALLY OPERATED LIFT TABLE

BACKGROUND OF THE INVENTION

1. Field of the Invention

The invention relates to lift tables and, more particularly, relates to a lift table 1) which has a support surface that is raised and lowered automatically with the imposition or removal of loads without the operation of any electronic or fluidic actuators and 2) which is transportable from site to site. The invention additionally relates to the use of such a lift table.

2. Discussion of the Related Art

Lift tables are well known for facilitating the stacking or unstacking of articles on pallets or other supports. The typical lift table incorporates a support platform and a mechanism for selectively raising or lowering the support platform into a position facilitating its loading or unloading. For instance, when articles such as lumber are to be loaded onto a pallet from a conveyor, the lift table's support platform can be positioned adjacent the end of the conveyor and raised to a height at which a pallet supported thereon is generally co-planar with the conveyor. The support platform is then lowered progressively as each successive layer of articles is loaded onto the pallet so that the effective support surface on which the articles are being stacked remains at essentially the same height. The support platform can also be progressively raised as articles stacked thereon are unloaded to maintain the row of articles being unloaded at any one time in substantially the same horizontal plane. Vertical movement of the support platform usually is accomplished via a scissor arm mechanism that supports the support platform on an underlying base and that is raised and lowered by way of one or more hydraulic or pneumatic cylinders. Lift tables of this type are commercially available from Bishamon Industries Corp. of Hialeah, Fla.; Presto Material Handling, a Division of Lee Engineering, of Pawtucket, R.I.; and Southworth Products Corp. of Portland, Me.

Traditional hydraulically operated or pneumatically operated lift tables exhibit marked drawbacks and disadvantages. For instance, the hydraulic or pneumatic cylinders required to operate the scissor arm mechanisms are somewhat expensive and, along with their associated supply and return hoses, are prone to leaks. They also must be coupled to a source of fluid pressure such as an internal or external pump. The pump and associated valves add to the cost and weight of the lift table and increase the likelihood of leaks.

In addition, the pump or other pressure source required for operation of a hydraulically or pneumatically operated lift table necessarily limits the mobility of the lift table. In those instances in which the pressure source is located on-board the lift table and powered by an external power source such as an AC power supply, the lift table cannot be used in remote locations where electrical power is unavailable. In those instances in which the pressure source is located off-board with respect to the lift table and has an integral power source, the pressure source must be connected to the cylinders by supply and return hoses—once again limiting the mobility of the lift table. As a result of these restraints on mobility, many lift tables are designed to be completely immobile with the lower ends of the scissor arm mechanism being mounted on a stationary frame.

In addition, arms, rollers and other components of the scissor arm mechanisms of traditional lift tables are not designed to minimize the effort required to vertically adjust the position of the support platform.

OBJECTS AND SUMMARY OF THE INVENTION

It is therefore a first object of the invention to provide a lift table that lacks any fluid pressure sources and that can be raised and lowered automatically solely by operation of an on-board mechanical mechanism that is responsive to the imposition and removal of loads to and from the lift table.

A second object of the invention is to provide a lift table that meets the first object of the invention and that can be easily moved from site to site.

In accordance with a first aspect of the invention, this object is achieved by providing a lift table comprising a support table assembly, a scissor arm mechanism, and a lift spring assembly. The support table assembly includes an upper support platform which has first and second longitudinally opposed end portions and a pair of laterally opposed side portions, and a pair of laterally opposed, longitudinally extending tracks on which the side portions of the support platform are supported. The scissor arm mechanism, which supports the support table assembly on a support surface, includes 1) a first set of arms including first and second parallel, laterally opposed arms, each of which has a first, upper end which engages the support table assembly and a second, lower end which is spaced longitudinally from the first end thereof, and 2) a second set of arms including third and fourth parallel laterally opposed arms, each of which has a first, upper end which engages the support table assembly and a second, lower end which is spaced longitudinally from the first end thereof. The first end of each of the arms of one of the first and second sets of arms is pivotably attached to the support table assembly. The first end of each of the arms of the other of the first and second sets of arms is rollably mounted in one of the tracks. The third arm is pivotally connected to the first arm at a first pivot point. The fourth arm is pivotally connected to the second arm at a second pivot point located in a common horizontal plane with the first pivot point. A wheel assembly rotatably supports the second end of each of the first, second, third, and fourth arms on the support surface.

The lift spring assembly imposes an upward force on one of the first and second sets of arms and a downward force on the other of the first and second sets of arms. The lift spring assembly compresses upon the imposition of a load on the support table assembly by an amount proportional to the magnitude of the load and extends upon removal of the load by an amount proportional to the magnitude of the load, thereby causing a vertical distance from the support table assembly to the support surface to vary automatically with the imposition or removal of loads by an amount that is proportional to the magnitude of the loads.

The lift spring assembly preferably includes a telescoping guide tube assembly and a helical compression spring. The guide tube assembly has an upper end pivotally supported on the first set of arms at a location above the common horizontal plane and a lower end pivotably supported on the second set of arms at a location beneath the common horizontal plane. The helical compression spring surrounds the guide tube assembly.

Yet another object of the invention is to provide an improved lift table that meets at least one of the above-mentioned objects of the invention and that exhibits an improved scissor arm mechanism that is better suited to mechanical operation than traditional scissor arm mechanisms.

In accordance with another aspect of the invention, this object is achieved by providing arms that each are bent generally upwardly at an acute angle from a longitudinal centerline extending from the bottom end of the arm to the pivot point of the arm. The acute angle preferably is between 6° and 10° and even more preferably is 8°.

Still another object of the invention is to provide a lift table that meets at least one of the first and second objects of the invention and that exhibits reduced friction in its motion so as to be more easily raised and lowered than traditional scissor arm mechanisms.

In accordance with another aspect of the invention, this object is achieved by causing the first end of each of the third and fourth arms to be rollably mounted in the respective one of the tracks by a low-friction bearing.

Yet another object of the invention is to provide an improved method of loading or unloading articles from a stack using a lift table that automatically positions the top of the stack at a desired height for loading or unloading.

In accordance with still another aspect of the invention, this object is achieved by first providing a lift table that generally meets the first object of the invention, then transporting the lift table to a location adjacent a conveyor by rolling the rollers along the support surface, such that the support platform is substantially coplanar or slightly below the conveyor. A first article is then transferred from the conveyor onto the support platform to impose a first load on the support table assembly, the lift spring assembly compressing upon the imposition of the first load by an amount that is generally proportional to the magnitude of the first load, thereby causing the support table assembly to lower automatically by an amount that is generally proportional to the magnitude of the first load and causing an upper surface of the first article to be substantially coplanar with the conveyor. A second article is then transferred from the conveyor onto the first article to impose a second load on the support table assembly, the lift spring assembly compressing upon the imposition of the second load by an amount that is generally proportional to the magnitude of the second load, thereby causing the support table assembly to lower automatically by an amount that is generally proportional to the magnitude of the second load and causing an upper surface of the second article to be substantially coplanar with or slightly below the conveyor. Finally, the second article is removed from the support table assembly to remove the second load from the support table assembly, the lift spring assembly extending upon the removal of the second load by an amount that is generally proportional to the magnitude of the second load, thereby automatically raising the support table assembly by an amount that is generally proportional to the magnitude of the second load and causing an upper surface of the first article to be substantially coplanar with or slightly below with the conveyor.

Other objects, features, and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. Resume

Figure 1:
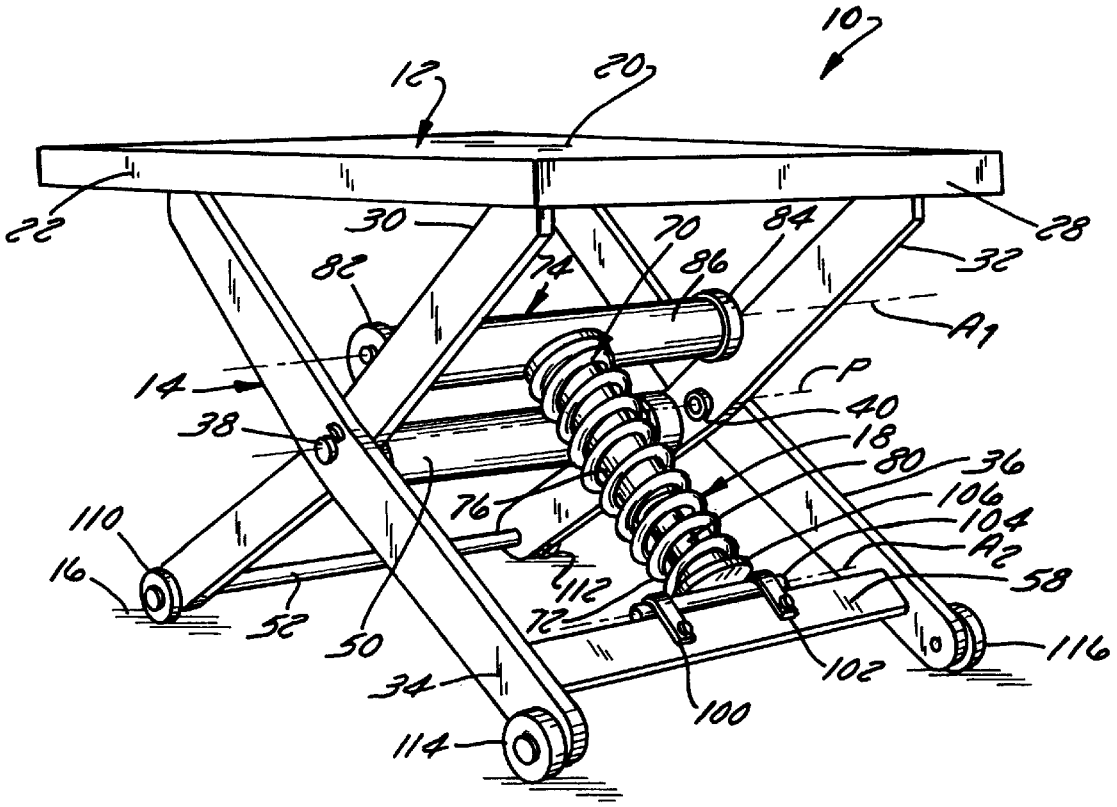
FIG. 1 is a perspective view of a lift table constructed in accordance with a preferred embodiment of the invention, showing the lift table in a fully raised position.

Pursuant to the invention, a lift table includes a support table assembly mounted on a scissor arm mechanism. The support table assembly is raised and lowered automatically upon the imposition or removal of loads so that the height of the plane on which articles are being handled remains generally constant. Raising and lowering is effected via a lift spring assembly that acts without the assistance of any pneumatic or hydraulic actuators. The scissor arm mechanism of the lift table has angled arms and low-friction rollers to facilitate raising and lowering of the support table assembly and optimizing operation of the lift spring assembly. The resulting mechanically operated lift table is simple, reliable, and can be easily transported from location to location.

2. Construction of Lift Table

Referring to the drawings, a lift table 10 constructed in accordance with the preferred embodiment of the invention includes a support table assembly 12 and a scissor arm mechanism 14 for raising and lowering the support table assembly 12 relative to a support surface 16. The scissor arm mechanism 14 includes scissor arms (detailed below), a wheel assembly (also detailed below) for facilitating site-to-site transport of the lift table, and a lift spring assembly 18 serving as a mechanical actuator for automatically raising and lowering the support table assembly 12 relative to the support surface 16.

The support table assembly 12 includes an upper support platform 20 and a pair of laterally opposed, longitudinally extending tracks 22, 24 for cooperation with the scissor arm mechanism 14. The platform 20 of the illustrated embodiment is configured for receiving pallets or other articles that may be larger than the platform 20. Hence, the platform 20 has a planar upper surface lacking side walls extending above the upper surface. The platform 20 includes first and second longitudinally opposed end portions and a pair of laterally opposed side portions. The tracks 22, 24 are formed from L-shaped members extending downwardly from the opposed lateral edges of the side portions of the platform 20 and extending along the entire longitudinal length of the platform 20. Complementary L-shaped members 26, 28 are located at the longitudinal ends of the platform 20 for purposes of strength and aesthetics. The front member 26 also serves as a stop for bearings 54 and 56 of the scissor arm mechanism 14 which are detailed below.

The scissor arm mechanism 14 may comprise any configuration of arms that includes at least first and second opposed sets of arms that are pivotally attached to one another so as to fold and unfold to lower and raise the support table assembly 12. The scissor arm mechanism 14 of the illustrated embodiment has only first and second sets of arms and, accordingly, is capable of only single stage lifting. However, the invention is equally applicable to a lift table in which the bottom end of each arm is connected to an arm of an underlying set to provide two-stage lifting capability.

In the illustrated embodiment, the first set of arms includes first and second parallel, laterally opposed arms 30 and 32, and the second set of arms includes third and fourth parallel, laterally opposed arms 34 and 36. Each arm 30, 32, 34, 36 has a first, upper end which engages the support table assembly 12 and a second, lower end that is spaced longitudinally from the first end and that is supported on the support surface 16 by the wheel assembly. The upper ends of the arms of one set are pivotally attached to the support table assembly 12, and the upper ends of the arms of the other set rollably support the support table assembly 12. In the illustrated embodiment, the upper ends of the arms 30 and 32 of the first set are pivotably attached to the support table assembly 12, and the upper ends of the arms 34 and 36 of the second set are rollably supported on the support table assembly 12. However, this configuration could be reversed without affecting the invention.

The first arm 30 is pivotably connected to the third arm 34 by a first pivot pin assembly 38 located at a first pivot point that is midway between the ends of each arm. The second arm 32 is pivotably connected to the fourth arm 36 by a second pivot pin assembly 40 located at a second pivot point that is located midway between the ends of each arm. The pivot points containing the pivot pin assemblies 38 and 40 are located in a common horizontal plane P with one another.

The upper ends of the first and second arms 30 and 32 present inwardly-extending pivot pins 42 and 44 which are received in U-clamps 46 and 48 bolted or otherwise attached to the undersurface of the support platform 20 in order to provide the desired pivotal connection of the first and second arms to the support table assembly 12. The first and second arms 30 and 32 are maintained in their parallel, spaced-apart relationship by a top mount tube 50 and a lower cross bar 52, both of which are welded or otherwise fixedly connected at or near their opposed ends to the first and second arms 30 and 32. The lower cross bar 52 also extends through the arms 30 and 32 to present outwardly-protruding ends that serve as axles for rollers 110 and 112 of the wheel assembly as detailed below.

The upper ends of the third and fourth arms 34 and 36 rotatably receive low-friction bearings 54 and 56 which are captured in the tracks 22 and 24 so as to roll along the tracks upon extension or retraction of the scissor mechanism 14 in order to provide the desired rolling contact with the support table assembly 12. The third and fourth arms 34 and 36 are maintained in their parallel, spaced-apart relationship by a lower cross bar 58 and by an upper cross bar 60. Upper cross bar 60 also extends through the arms 34 and 36 to present outwardly-protruding ends that serve as axles for the bearings 54 and 56.

Figure 2:
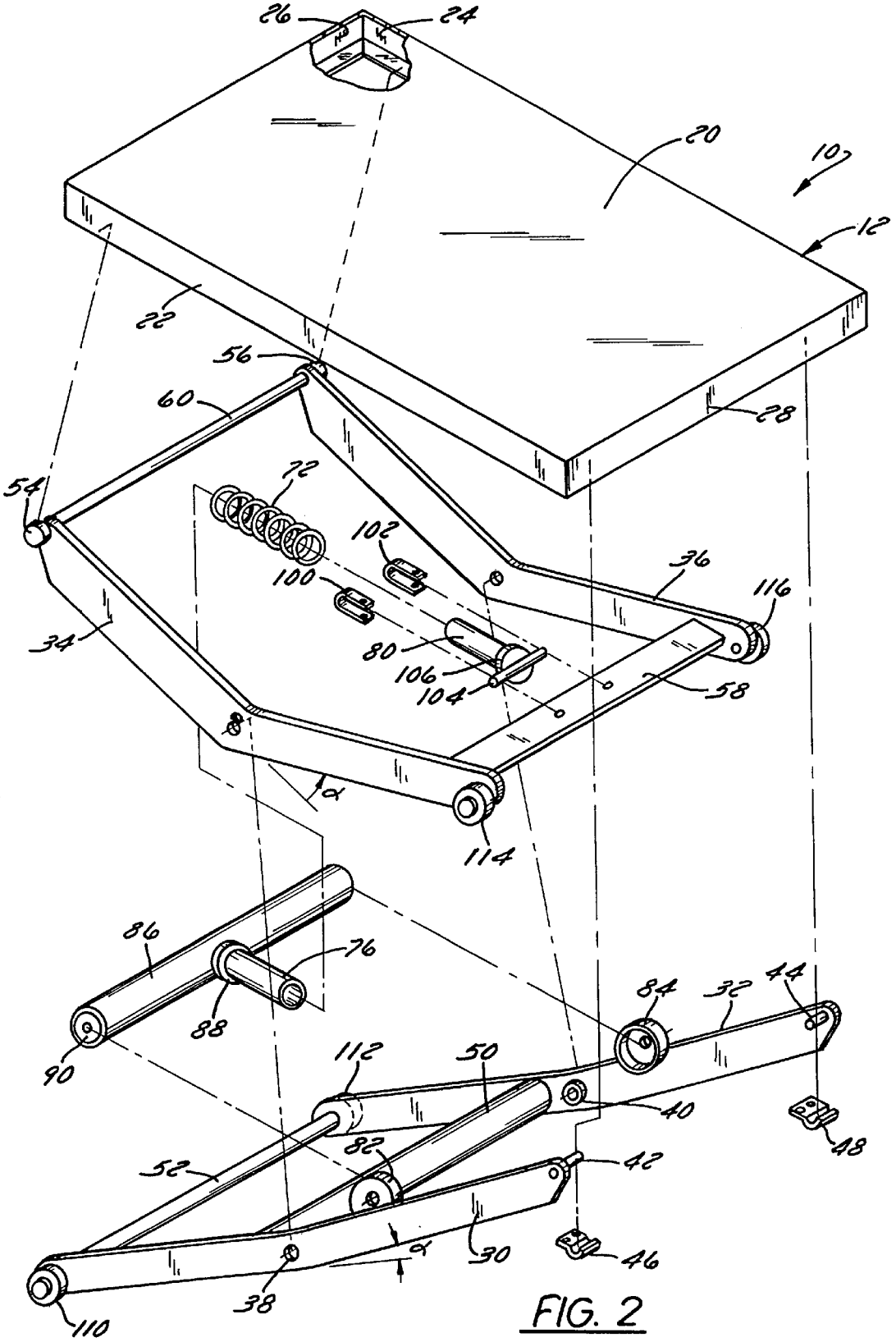
FIG. 2 is an exploded perspective view of the lift table of FIG. 1.
Figure 9:
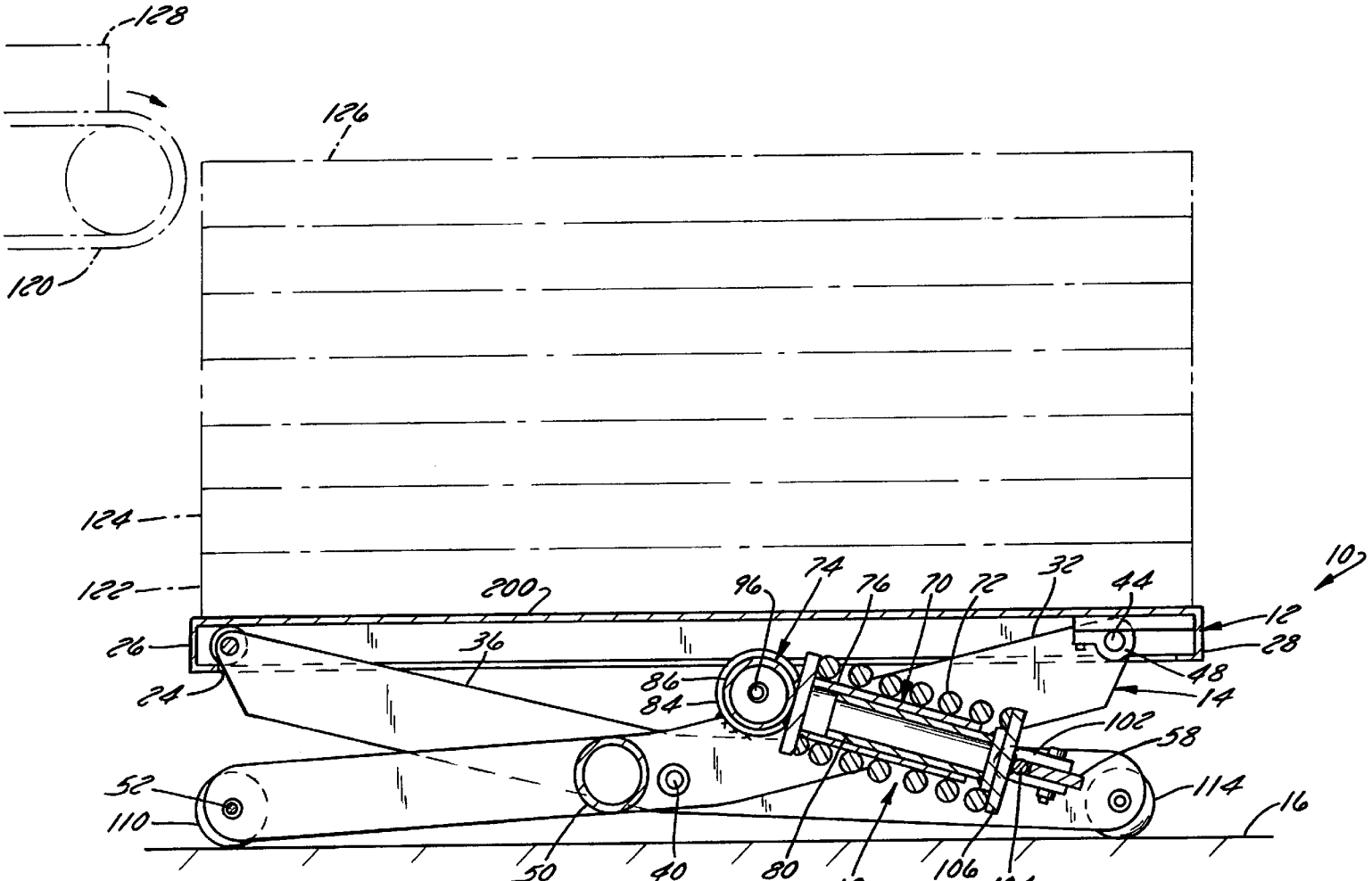
FIG. 9 corresponds to FIG. 8 and shows the lift table near its fully lowered position.

Each of the arms 30, 32, 34, 36 is constructed from ¾"×3½" flat steel and is about 45" long. The distance from the pivot point of each arm to the lower support point (the point for connection to a roller in the illustrated embodiment) is about 21". The arms 30, 32, 34, and 36 are designed to facilitate the automatic mechanical adjustment of the lift table. Most notably, and as best seen in FIG. 2, rather than being straight, each arm is bent at the pivot point such that the upper end portion of the arm extends inwardly and upwardly at an acute angle $\alpha$ from a longitudinal centerline extending from the lower end of the arm to the pivot point. This angle a is relatively small—on the order of less than 15°. In the illustrated embodiment, the angle $\alpha$ is set between 6° and 10° and preferably about 8°. Angling or bending the arms in this fashion increases their overall load bearing capability. Moreover, as best seen in FIG. 9, the bend in the arms 30, 32, 34, 36 helps to conceal the upper end of the lift spring assembly 18, allows for optimal positioning of the pivot points, and increases the available space for interaction between the lift spring assembly 18 and the arms.

The lift spring assembly 18 is designed to automatically vary the height of the support table assembly 12 upon the imposition or removal of loads to or from the support table assembly 12 by an amount that is proportional to the magnitude of the imposed or removed loads. The lift spring assembly 18 performs this automatic adjustment purely mechanically, i.e., without the assistance of any hydraulic, pneumatic, or electrical power sources. The lift spring assembly 18 is also designed to be relatively simple and inexpensive to fabricate and to install.

Towards these ends, the lift spring assembly 18 includes 1) a telescoping guide tube assembly 70 and 2) and a helical compression spring 72 that surrounds and is guided by the guide tube assembly 70. In the illustrated embodiment, the upper end of the guide tube assembly 70 is supported on the first set of arms 30 and 32 and the lower end is supported on the second set of arms 34 and 36. This orientation could be reversed without adversely affecting the operation of the lift spring assembly 18 so long as one end of the guide tube assembly 70 is connected to one set of arms at a location above the horizontal plane P containing the pivot pin assemblies 38 and 40 and the other end of the guide tube assembly 70 is connected to the other set of arms at a location beneath the horizontal plane P.

The illustrated guide tube assembly 70 includes an upper horizontal tube support 74, a female tube 76, a lower horizontal tube support 78, and a male tube 80. The female tube 76 has an upper end fixed to the upper horizontal tube support 74 and has an open lower end. The male tube 80 has a lower end fixed to the lower horizontal tube support 78 and has an upper end slidably received in the open lower end of the female tube 76 so as to permit the guide tube assembly 70 to telescope upon itself.

Figure 7:
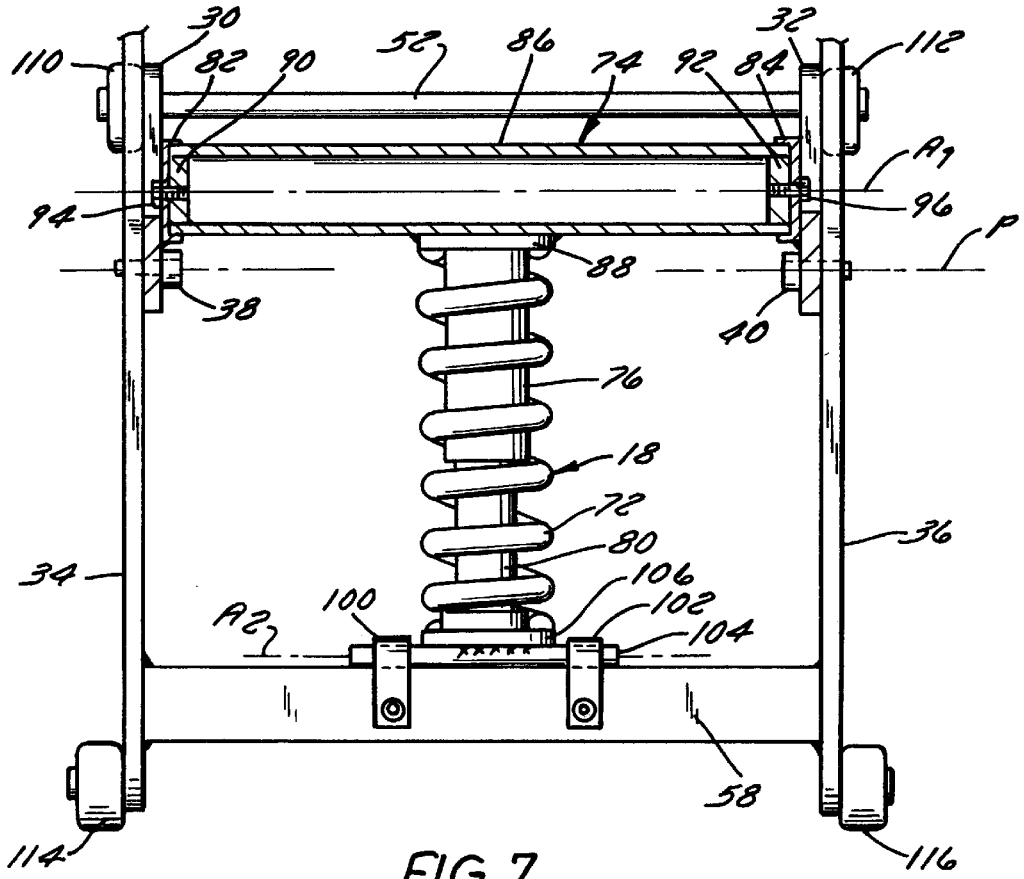
FIG. 7 is a partially cut-away elevation view of the lift spring assembly of the lift table and of the associated supports and arms, taken generally along the lines 7—7 in FIG. 8.

The upper horizontal support tube 74 comprises a first bearing cup 82 welded or otherwise affixed to the inner lateral surface of the first arm 30, a second bearing cup 84 welded or otherwise affixed to the inner lateral surface of the second arm 32, and a tubular shaft 86 which extends between the first and second bearing cups 82 and 84 as best seen in FIG. 7. The upper end of the female tube 76 is fixed to the central portion of the shaft 86 via a welded collar arrangement 88. Internally threaded end caps 90 and 92 are welded or otherwise affixed in the opposed ends of the shaft 86 for threadedly receiving bearing studs 94 and 96 that in turn are rotatably supported in axial bores formed in the ends of the bearing cups 82 and 84, thereby rotatably supporting the shaft 86 in the bearing cups 82 and 84 so that the shaft 86 rotates about an axis $A_1$. It should be noted that the bearing cups 82 and 84 are off-set from the longitudinal centerline of the arms 30 and 32 so that the bearing studs 94 and 96 are located beyond the lateral edges of the arms 30 and 32 to facilitate assembly. Mounting the bearing cups 82 and 84 in this location also permits locating that axis $A_1$ of the shaft 86 at a position that optimizes the lifting and lowering forces imposed by the spring 72. In the illustrated embodiment, the axis $A_1$ is located about 4⅞" away from a horizontal line containing the pivot pin assemblies 38 and 40.

The lower horizontal tube support 78 includes the horizontal brace 58 (briefly described above), first and second U-clamps 100 and 102, and a pivot rod 104. The clamps 100 and 102 are bolted or otherwise affixed to the horizontal brace 58 between the longitudinal ends of the brace in a longitudinally spaced-apart relationship. The pivot rod 104 is welded to an enlarged head 106 of the male tube 80 so as to extend sufficiently far beyond the opposed sides of the head 106 that it extends through the U-clamps 100 and 102. The U-clamps 100 and 102 act as bearings rather than clamps. That is, they do not impose a significant clamping force on the pivot rod 104 but instead permit the rod 104 and the male tube 80 to pivot about an axis $A_2$ without significant resistance.

The spring 72 may comprise any helical compression spring that is sufficiently stiff to raise an unloaded support table assembly 12 to its uppermost position and to compress with the imposition of loads on the support table assembly 12 by an amount that is proportional to the magnitude of the imposed loads. The illustrated spring 72 is formed from 10 coils, has a 5" outside diameter, a coil thickness of ⅞" (for an inside diameter of 3⅛"), and an overall uncompressed length of 14½". The spring 72 preferably is made from chromium vanadium SAE 615 alloy spring steel.

Finally, the wheel assembly may include any wheeled structure that permits transport of the lift table 10 from site to site. The wheel assembly could for example comprise a cart on which the bottom ends of the arms 30, 32, 34, and 36 are supported, or it could comprise rollers configured to roll along a track. In the illustrated embodiment in which the lift table 10 is designed to facilitate loading and unloading of lumber or other articles in an open space, the wheel assembly is configured to roll along open ground. Specifically, the wheel assembly includes first, second, third, and fourth rollers 110, 112, 114 and 116 that support the first, second, third, and fourth arms 30, 32, 34 and 36, respectively. The first and second rollers 110 and 112 are mounted on the protruding ends of the cross bar 52. The second and third rollers 114 and 116 are rotatably mounted on stub axles extending transversely from the ends of the arms 34 and 36.

Several advantages and benefits of the invention were discussed above. Others will become apparent from the following description of the operation of the lift table.

3. Operation Of Lift Table

Figure 4:
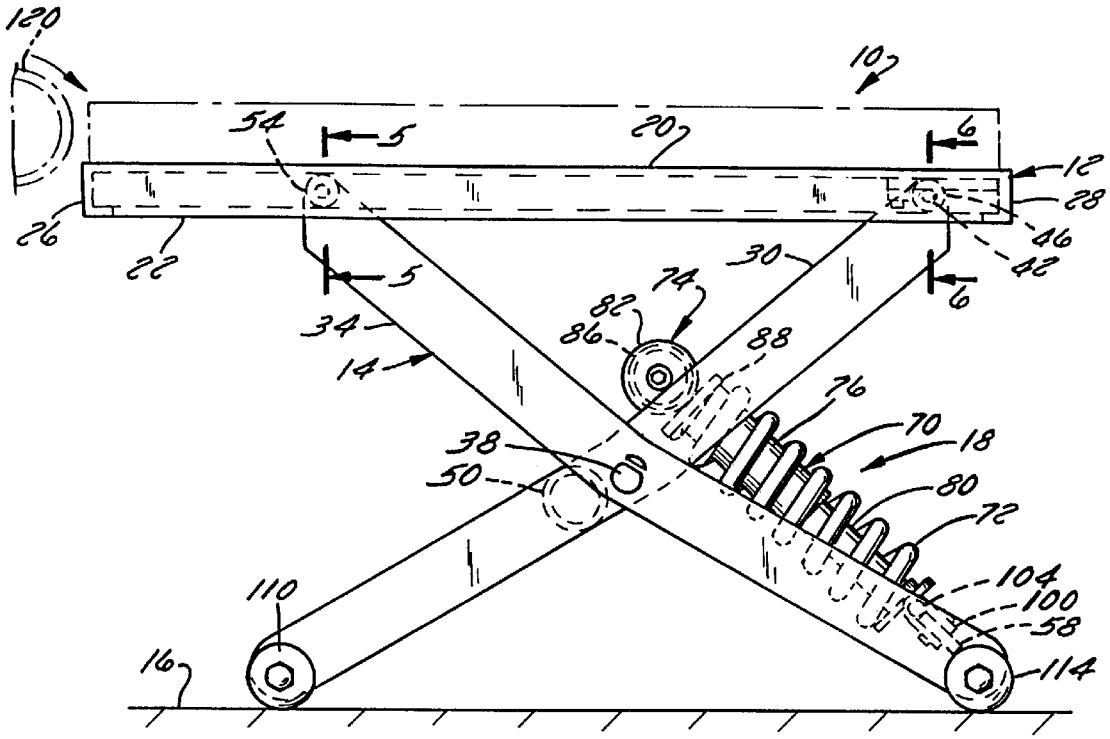
FIG. 4 is a side elevation view of the lift table of FIG. 1 and of the end of an associated conveyor.
Figure 3:
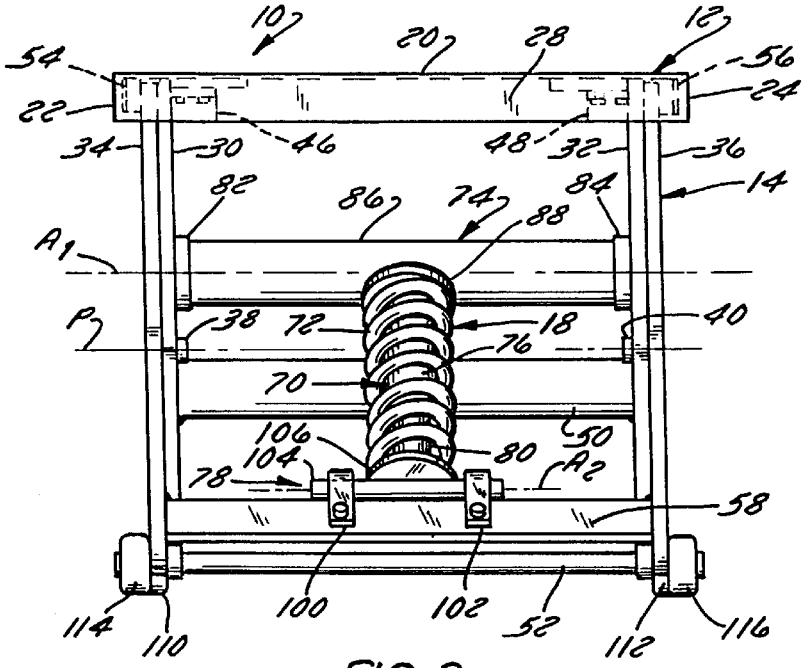
FIG. 3 is a rear end elevation view of the lift table.
Figure 5:
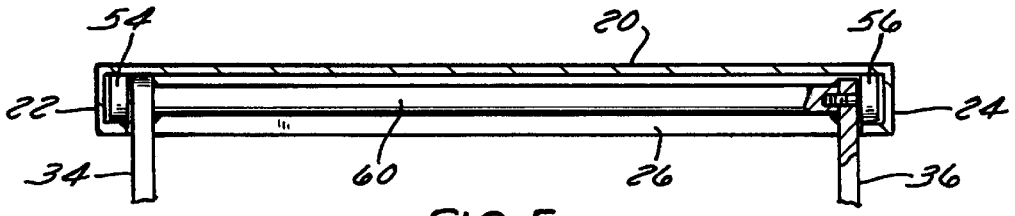
FIGS. 5 and 6 are sectional end elevation views taken along the lines 5—5 and 6—6, respectively, in FIG. 4.
Figure 6:
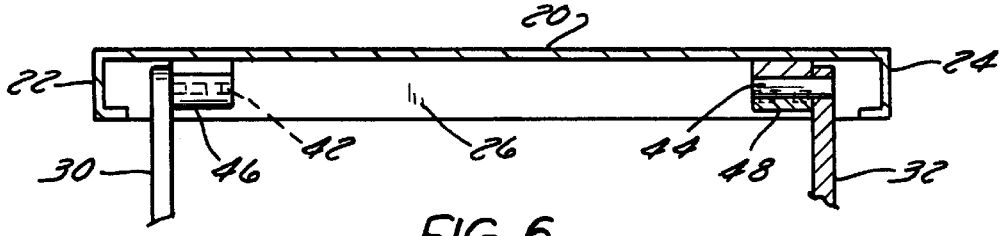
Figure 8:
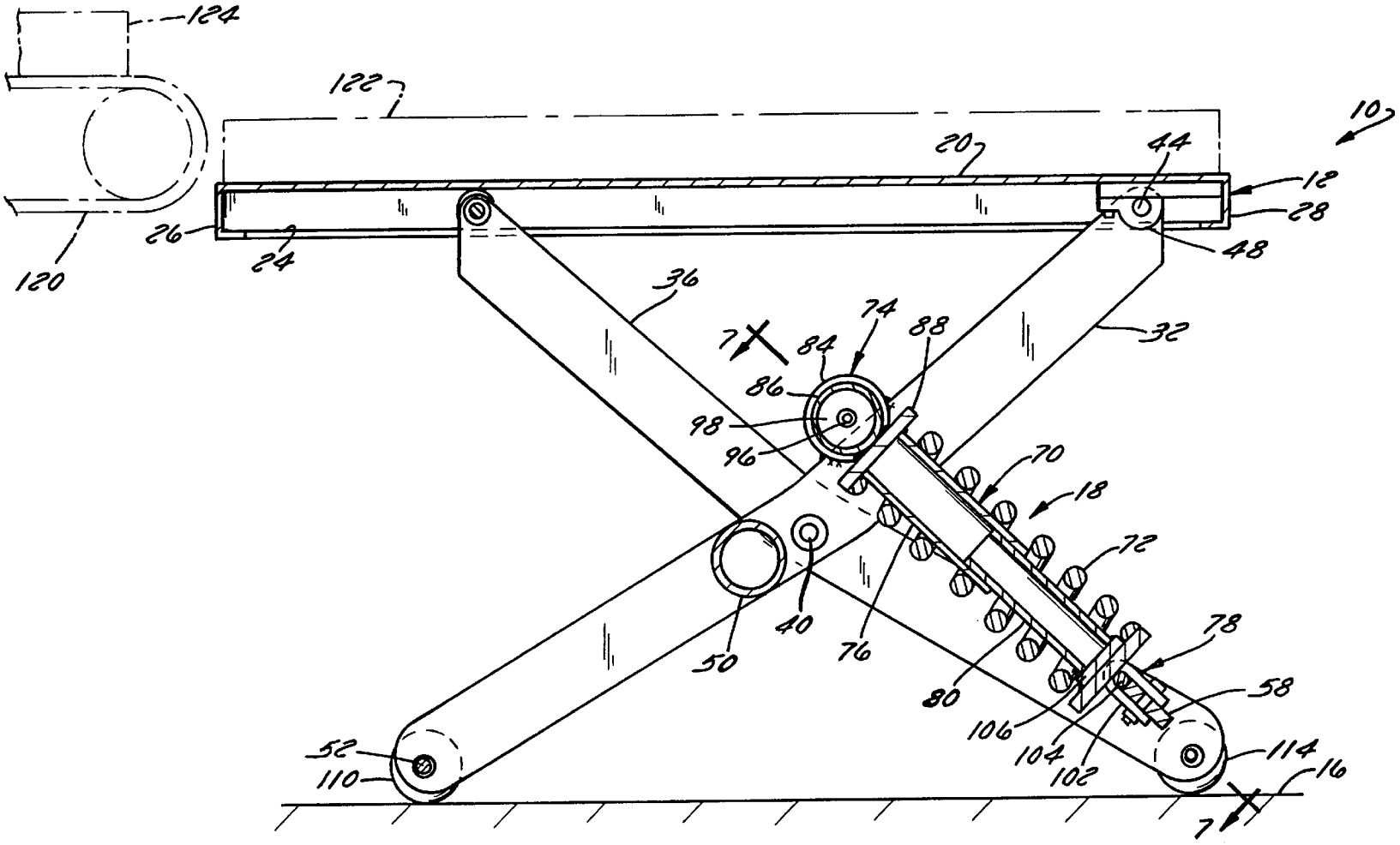
FIG. 8 is a sectional side elevation view of the lift table and of the associated conveyor, showing the conveyance of articles onto the lift table when it is near a fully-raised position.

Referring now to FIGS. 4, 8 and 9, operation of the lift table 10 will be described in conjunction with a palletizing operation in which pieces of lumber or some other articles are delivered from a conveyor 120 to the lift table 10 and stacked on top of one another. The lift table 10 is prepared for the stacking operation simply by rolling it along its rollers 110, 112, 114 and 116 so that it is aligned with the discharge end of the conveyor 120 as seen in FIGS. 4 and 8 with the upper surface of the its support platform 20 being generally co-planar or slightly below the surface of the conveyor 120. Transport is simplified by the fact that the lift table 10 need not be connected to any external hydraulic, pneumatic, or electrical power sources and lacks any on-board power sources that would increase the weight and maneuverability of the lift table.

Next, a first article 122 is conveyed onto the platform 20 from the conveyor 120. The weight of this article 122 will compress the lift spring assembly 18 to collapse the scissor arm mechanism 14 and to lower the support table assembly 12 by an amount that is generally proportional to the weight of the article 122. Assuming that the spring constant of the spring 72 is selected to accommodate articles of a designated weight and thickness, the weight of the article 122 will compress the lift spring assembly 18 just enough so that the upper surface of the first article 122 is generally co-planar or slightly below the surface of the conveyor 120 as seen in FIG. 8. The second article 124 (only seen in part in FIG. 8) then can be smoothly transferred and stacked on top of the first article 122. The weight of the second article 124 will compress the lift spring assembly 18 to lower the support table assembly 12 to a position in which the upper surface of the second article 124 is generally co-planar with the conveyor 120. This process is then repeated on an article-by-article basis until, as seen in FIG. 9, the scissor arm mechanism 14 is essentially fully collapsed after the last article 128 is conveyed onto the stack with the upper surface of the next-to-last article 126 essentially being co-planar with the conveyor 120.

The lift spring assembly 18 also facilitates lift table unloading by automatically raising the support table assembly 12 by a designated amount with the removal of each successive article. Hence, if the conveyor 120 of FIG. 9 were a take-off conveyor rather than a supply conveyor, transfer of each successive article 128, 126, etc. from the support table assembly 12 onto the conveyor 120 and subsequent removal of the article's weight from the lift table assembly 12 will cause the spring 72 to push the support table assembly 12 up to a position in which the next article 126, etc. in the stack is positioned for article removal.

Vertical movement of the support table assembly 12 is facilitated by use of the low friction bearings 54 and 56 as the roller elements for supporting the platform 20 on the third and fourth arms 34 and 36. Moreover, the bend in the arms 30, 32, 34 and 36 and the location of this bend relative to the rotational axis $A_1$ of the shaft 86 permits the scissor arm mechanism 14 to collapse almost completely with consequent near-complete lowering of the support table assembly 12 without interference from the lift spring assembly 18 and without detracting from the mechanical advantage of the lift spring assembly 18.

It can thus be seen that the lift table 10 represents a simple, effective mechanism for automatically adjusting the height of the support table assembly 12 of the lift table 10 without the use of any on-board or external power sources and without the potential inconvenience of leaking or ruptured hoses. The amount of vertical movement that the support table assembly 12 undergoes with the imposition of a designated load can be easily selected simply by selecting a spring of a desired spring constant and can be varied simply by replacing the spring 72 with a spring of a different, designated spring constant. The construction and arrangement of the various components of the lift table advantageously makes changing springs 72 a quick and simple task.

Many changes and modifications could be made to the invention without departing from the spirit thereof. The scope of some of these changes were discussed above. The scope of the remaining changes will become apparent from the appended claims.

I claim:

1. A lift table comprising:

(A) a support table assembly including (1) an upper support platform which has first and second longitudinally opposed end portions and a pair of laterally opposed side portions, and (2) a pair of laterally opposed, longitudinally extending tracks on which said side portions of said support platform are supported;

(B) a scissor arm mechanism which supports said support table assembly on a support surface, said scissor arm mechanism including (1) a first set of arms including first and second parallel, laterally opposed arms, each of which has a first, upper end which engages said support table assembly and a second, lower end which is spaced longitudinally from said first end thereof, (2) a second set of arms including third and fourth parallel, laterally opposed arms, each of which has a first, upper end which engages said support table assembly and a second, lower end which is spaced longitudinally from said first end thereof, wherein the first end of each of the arms of one of said first and second sets of arms is pivotably attached to said support table assembly, wherein the first end of each of the arms of the other of said first and second sets of arms is rollably mounted in one of said tracks, wherein said third arm is pivotally connected to said first arm at a first pivot point, and wherein said fourth arm is pivotally connected to said second arm at a second pivot point located in a common horizontal plane with said first pivot point, (3) a wheel assembly which rotatable supports said second end of each of said first, second, third, and fourth arms on said support surface; and (4) a lift spring assembly which imposes an upward force on one of said first and second sets of arms and a downward force on the other of said first and second sets of arms, said lift spring assembly compressing upon the imposition of a load on said support table assembly by an amount proportional to the magnitude of said load and extending upon removal of said load by an amount proportional to the magnitude of said load, thereby causing a vertical distance from said support table assembly to said support surface to vary automatically with the imposition or removal of loads by an amount that is generally proportional to the magnitude of said loads, wherein said lift spring assembly includes a) a telescoping guide tube assembly having an upper end pivotally supported on said first set of arms at a location above said common horizontal plane and a lower end pivotably supported on said second set of arms at a location beneath said common horizontal plane, and b) a helical compression spring that surrounds said guide tube assembly, and, wherein said guide tube assembly comprises an upper horizontal tube support rotatable supported on said first set of arms at said location above said common horizontal plane, a female tube having an upper end fixed to said upper horizontal tube support and having an open lower end, a lower horizontal tube support rotatable supported on said second set of arms at said location beneath said common horizontal plane, and a male tube having a lower end fixed to said lower horizontal tube support and having an upper end slidably received in said open lower end of said female tube, and wherein said upper horizontal tube support comprises a first bearing cup fixed to only said first arm, a second bearing cup fixed to only said second arm, and a shaft which extends between said first and second bearing cups, said shaft having first and second ends which are surrounded by and rotatably journaled in said first and second bearing cups, said upper end of said female tube being fixed to a central portion of said shaft.

2. A lift table as defined in claim 1, wherein said first bearing cup is fixed to said first arm at a location that is offset from a longitudinal center of said first arm, and wherein said second bearing cup is fixed to said second arm at a location that is offset from a longitudinal center of said second arm, and further comprising 1) a first bearing that rotatably mounts said shaft in said first bearing cup, said first bearing being located beyond a lateral edge of said first arm, and 2) a second bearing that rotatably mounts said shaft in said second bearing cup, said second bearing being located beyond a lateral edge of said second arm.

3. A lift table comprising:

(A) a support table assembly including (1) an upper support platform which has first and second longitudinally opposed end portions and a pair of laterally opposed side portions, and (2) a pair of laterally opposed, longitudinally extending tracks on which said side portions of said support platform are supported;

(B) a scissor arm mechanism which supports said support table assembly on a support surface, said scissor arm mechanism including (1) a first set of arms including first and second parallel, laterally opposed arms, each of which has a first, upper end which engages said support table assembly and a second, lower end which is spaced longitudinally from said first end thereof, (2) a second set of arms including third and fourth parallel, laterally opposed arms, each of which has a first, upper end which engages said support table assembly and a second, lower end which is spaced longitudinally from said first end thereof, wherein the first end of each of the arms of one of said first and second sets of arms is pivotably attached to said support table assembly, wherein the first end of each of the arms of the other of said first and second sets of arms is rollably mounted in one of said tracks, wherein said third arm is pivotally connected to said first arm at a first pivot point, and wherein said fourth arm is pivotally connected to said second arm at a second pivot point located in a common horizontal plane with said first pivot point, (3) a wheel assembly which rotatably supports said second end of each of said first, second, third, and fourth arms on said support surface; and (4) a lift spring assembly which imposes an upward force on one of said first and second sets of arms and a downward force on the other of said first and second sets of arms, said lift spring assembly compressing upon the imposition of a load on said support table assembly by an amount proportional to the magnitude of said load and extending upon removal of said load by an amount proportional to the magnitude of said load, thereby causing a vertical distance from said support table assembly to said support surface to vary automatically with the imposition or removal of loads by an amount that is generally proportional to the magnitude of said loads, wherein said lift spring assembly includes a) a telescoping guide tube assembly having an upper end pivotally supported on said first set of arms at a location above said common horizontal plane and a lower end pivotably supported on said second set of arms at a location beneath said common horizontal plane, and b) a helical compression spring that surrounds said guide tube assembly, and wherein said guide tube assembly comprises an upper horizontal tube support rotatably supported on said first set of arms at said location above said common horizontal plane, a female tube having an upper end fixed to said upper horizontal tube support and having an open lower end, a lower horizontal tube support rotatably supported on said second set of arms at said location beneath said common horizontal plane, and a male tube having a lower end fixed to said lower horizontal tube support and having an upper end slidably received in said open lower end of said female tube, and wherein said lower horizontal tube support comprises a horizontal brace having a first end fixed to said third arm and a second end fixed to said fourth arm, first and second U-clamps fixed to said horizontal brace between said first and second ends of said horizontal brace, and a pivot rod which is non-rotatably secured to said lower end of said male tube, which has portions extending beyond opposite sides of said male tube, and which is rotatably mounted on said horizontal brace by said first and second U-clamps, wherein said U-clamps extend around said extending pivot rod portions.

4. A lift table comprising:

(A) a support table assembly including (1) an upper support platform which has first and second longitudinally opposed end portions and a pair of laterally opposed side portions, and (2) a pair of laterally opposed, longitudinally extending tracks on which said side portions of said support platform are supported;

(B) a scissor arm mechanism which supports said support table assembly on a support surface, said scissor arm mechanism including (1) a first set of arms including first and second laterally opposed, parallel arms, each of which has a first, upper end which is pivotably attached to said support table assembly and a second, lower end which is spaced longitudinally from said first end thereof, (2) a second set of arms including third and fourth laterally opposed, parallel arms, each of which has a first, upper end which is rollably mounted in one of said tracks by a respective bearing and a second, lower end which is spaced longitudinally from said first end thereof, wherein said third arm is pivotally connected to said first arm at a first pivot point, wherein said fourth arm is pivotally connected to said second arm at a second pivot point located in a common horizontal plane with said first pivot point, and wherein each of said arms is bent generally upwardly, at the associated pivot point thereof, at an acute angle of 8° from a longitudinal centerline extending from the lower end of the arm to the pivot point of the arm, (3) a wheel assembly comprising first, second, third, and fourth wheels, each of which rotatably supports the second end of a respective one of said first, second, third, and fourth arms, and (4) a lift spring assembly which imposes an upward force on said first set of arms and a downward force on said second set of arms, said lift spring assembly compressing upon the imposition of a load on said support table assembly by an amount proportional to the magnitude of said load and extending upon removal of said load by an amount proportional to the magnitude of said load, thereby causing a vertical distance from said support table assembly to said support surface to vary automatically with the imposition or removal of loads by an amount that is proportional to the magnitude of said loads, wherein said lift spring assembly includes (a) a telescoping guide tube assembly having an upper end pivotally supported on said first set of arms at a location above said common horizontal plane and a lower end pivotably supported on said second set of arms at a location beneath said common horizontal plane, said guide tube assembly including (i) an upper horizontal tube support including a) a first bearing cup welded to said first arm at a location that is offset from a longitudinal centerline of said first arm, b) a second bearing cup welded to said second arm at a location that is offset from a longitudinal centerline of said second arm, and c) a shaft which extends between said first and second bearing cups, said shaft having first and second ends which are surrounded by and which are rotatably supported by said first and second bearing cups by first and second bearings that are located beyond lateral edges of said first and second arms, respectively, (ii) a female tube having an upper end fixed to a central portion of said shaft and having an open lower end, (iii) a lower horizontal tube support including a) a horizontal brace having a first end fixed to a said third arm and a second end fixed to said fourth arm, b) first and second U-clamps fixed to said horizontal brace between said first and second ends of said horizontal brace, and c) a pivot rod which is rotatably mounted on said horizontal brace by said first and second U-clamps, and (iv) a male tube having a lower end fixed to said pivot rod at a location between said first and second U-clamps and having an upper end slidably received in said open lower end of said female tube, wherein said pivot rod has portions extending beyond opposite sides of said male tube and is non-rotatably secured to said lower end of said male tube, and wherein said U-clamps extend around said extending pivot rod portions, and (b) a helical compression spring that surrounds said guide tube assembly, wherein said helical compression spring is formed from chromium alloy spring steel, has approximately 10 coils each having a thickness of about ⅞", and has an outer diameter of about 5".

* * * * *